US005481233A

United States Patent [19]

Manolache et al.

[11] Patent Number: 5,481,233

[45] Date of Patent: Jan. 2, 1996

[54] MICROWAVE SELECTIVE DEVICES USING LOCALIZED MODES IN WEAKLY ASYMMETRIC RESONANT CAVITIES

[76] Inventors: Florin Manolache, Str. A. Panu Nr. 30, BL. 28, SC.C, Ap.11, Iasi 6600, Romania; Sorin Costiner, C/O Putinar, 41484 Avenida de la Reina, Temecula, Calif. 92592

[21] Appl. No.: 218,359

[22] Filed: Mar. 25, 1994

[30] Foreign Application Priority Data

Mar. 28, 1993 [IL] Israel ..... 105184

[51] Int. Cl.[6] ..... H01P 7/06

[52] U.S. Cl. ..... 333/227; 333/232

[58] Field of Search ..... 333/101, 126, 333/129, 227, 232, 135

[56] References Cited

U.S. PATENT DOCUMENTS

| | | | |
|---|---|---|---|
| 3,076,157 | 1/1963 | Manwarren | 333/227 |
| 4,110,709 | 8/1978 | Day, Jr. | 333/135 |
| 4,168,478 | 9/1979 | Schuegraf | 333/135 |
| 4,453,146 | 6/1984 | Fiedziuszko | 333/227 |
| 4,527,137 | 7/1985 | Hartley | 333/135 |
| 4,881,051 | 11/1989 | Tang et al. | 333/135 |
| 5,349,316 | 9/1994 | Sterns | 333/135 |

FOREIGN PATENT DOCUMENTS

| | | | |
|---|---|---|---|
| 0604305 | 1/1985 | Japan | 333/135 |
| 1415281 | 8/1988 | U.S.S.R. | 333/135 |

OTHER PUBLICATIONS

Rosenberg, Uwe "Multiplexing and Double Band Filtering With Common–Multimode Cavities" (*IEEE Trans.* MTT vol. 38, No. 12 pp. 1862–1871, 1990).

Sridhar, S. "Experimental Observations of Scarred Eigenfunctions of Chaotic Microwave Cavities" (*Physical Review Letters,* vol. 67, No. 7 pp. 785–788, 1991).

*Primary Examiner*—Robert J. Pascal
*Assistant Examiner*—Darius Gambino

[57] ABSTRACT

A microwave cavity device having close frequency resonant modes wherein the major portion of the electromagnetic field energy of each mode is localized in a different region of the cavity is presented. The device can comprise one or several inputs, one or several outputs and tuning elements. These, together with the localization of the modes make the device suitable for different applications such as filters, multiplexors, switches. A class of cavities presenting localized modes are disclosed. These cavities are used in embodiments which have the advantage of being relatively simple, compact, with low insertion loss, high quality factor and simple tuning. Such cavities can be coupled in larger structures.

8 Claims, 7 Drawing Sheets

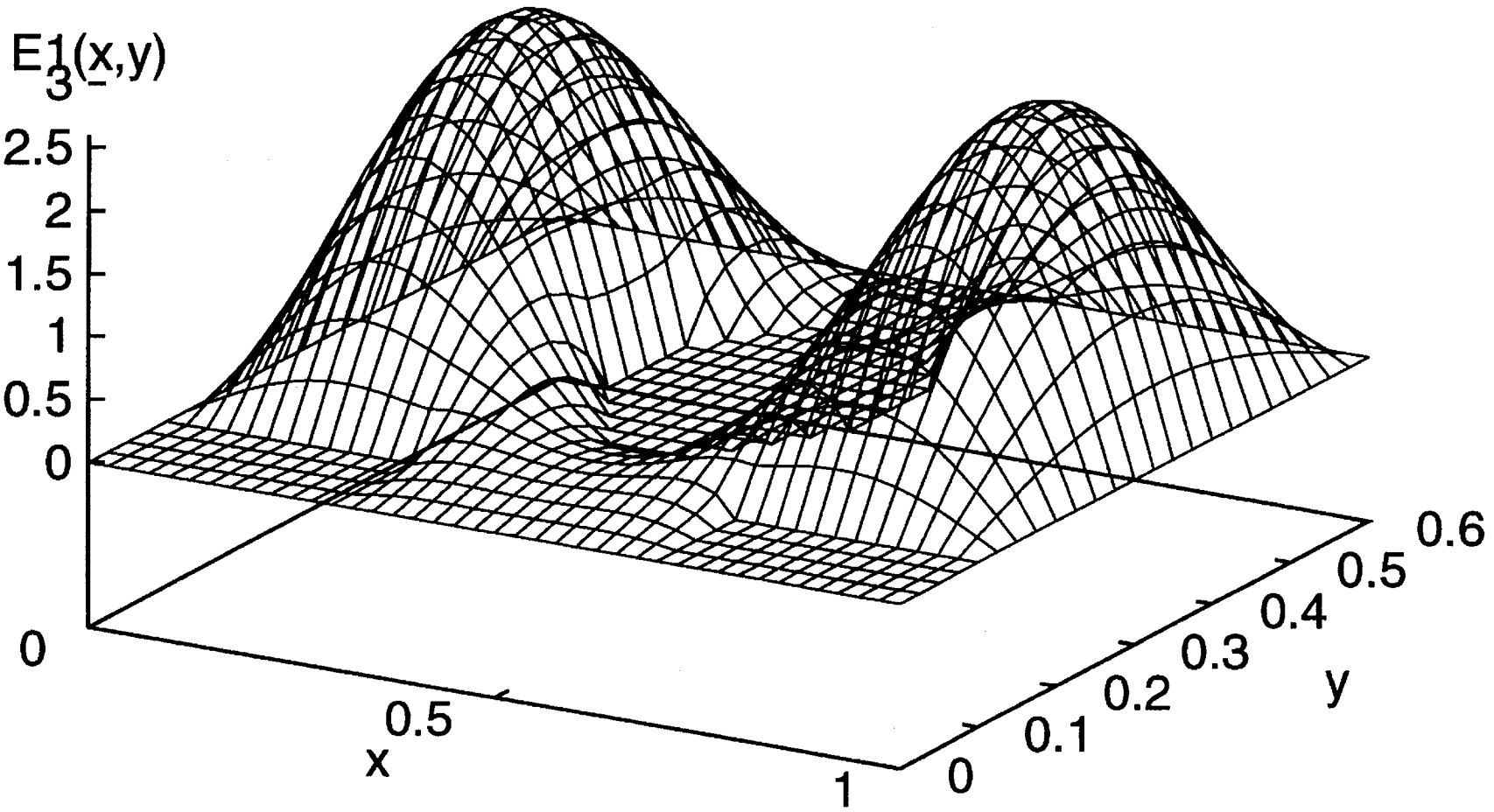
Fig. 3.A

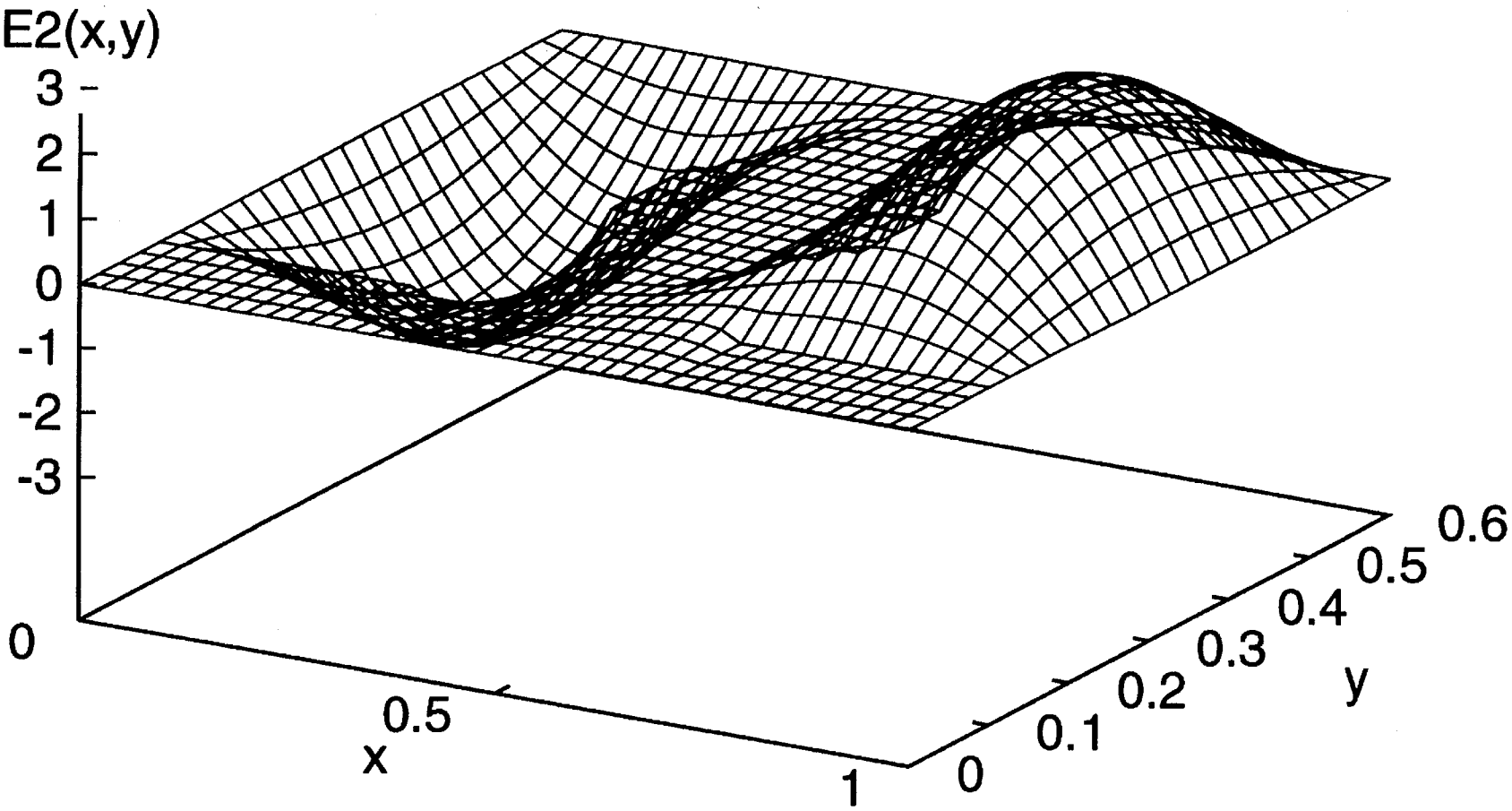
Fig. 3.B

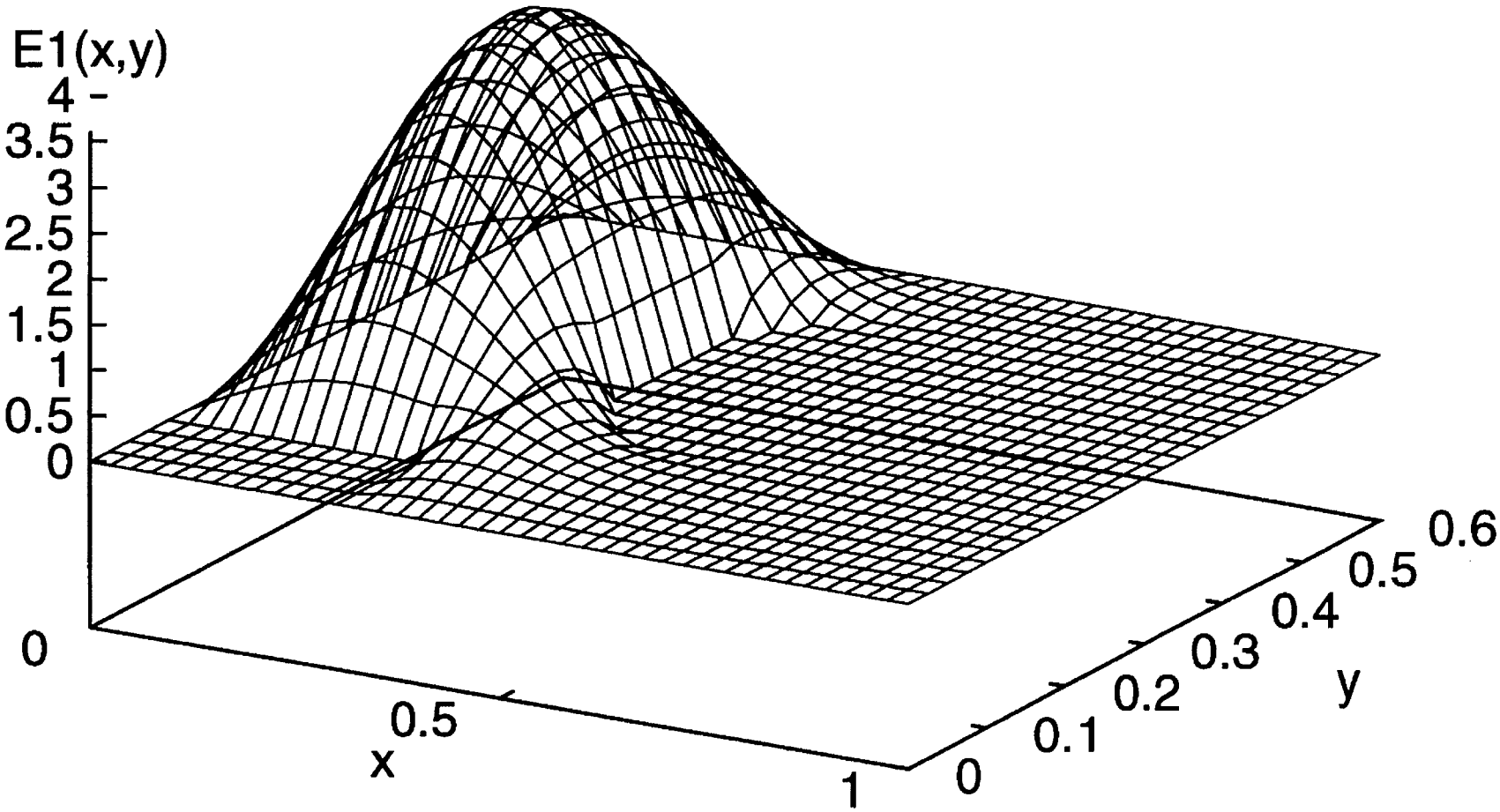
Fig. 4.A

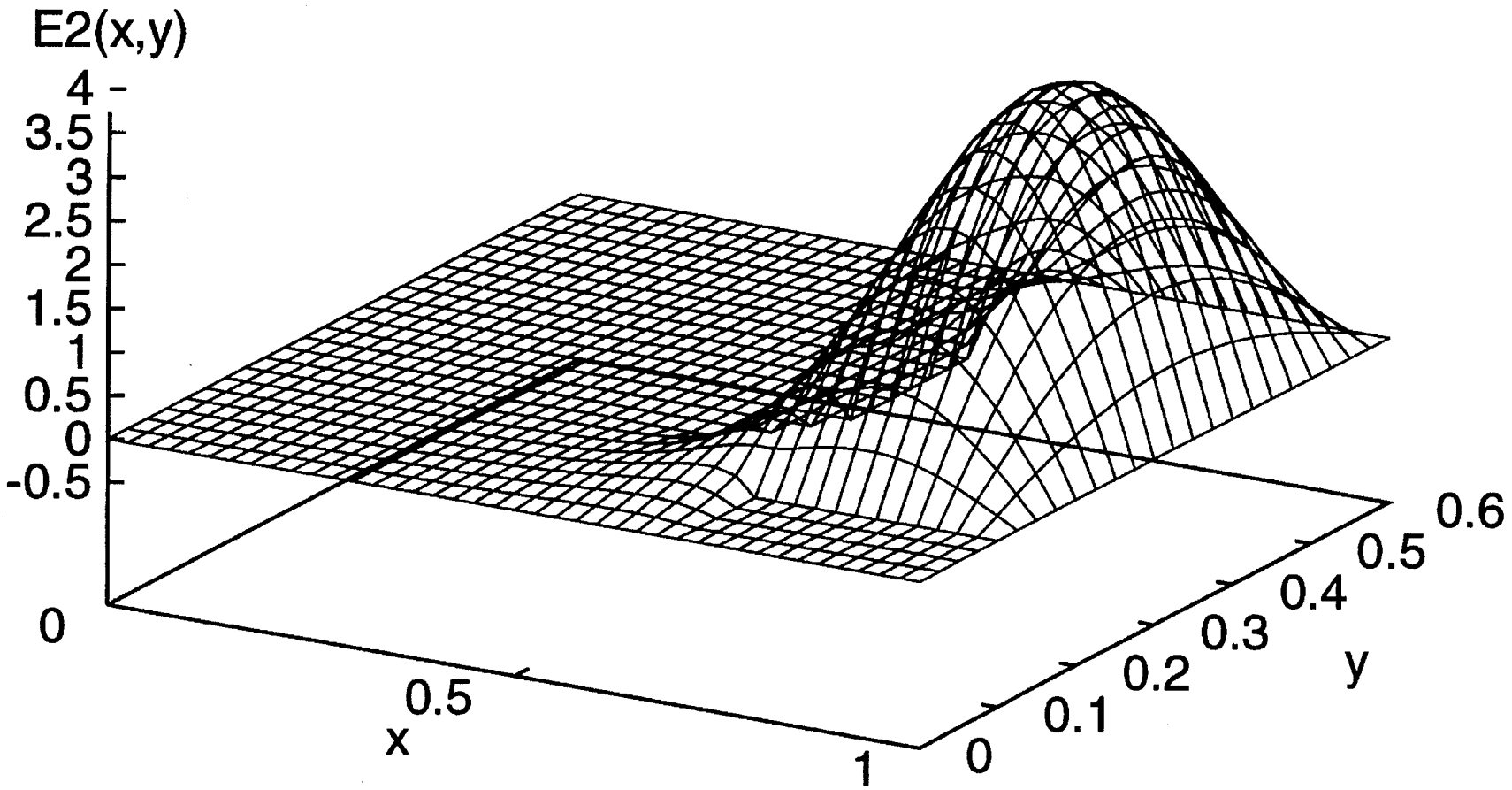
Fig. 4.B

Fig.5
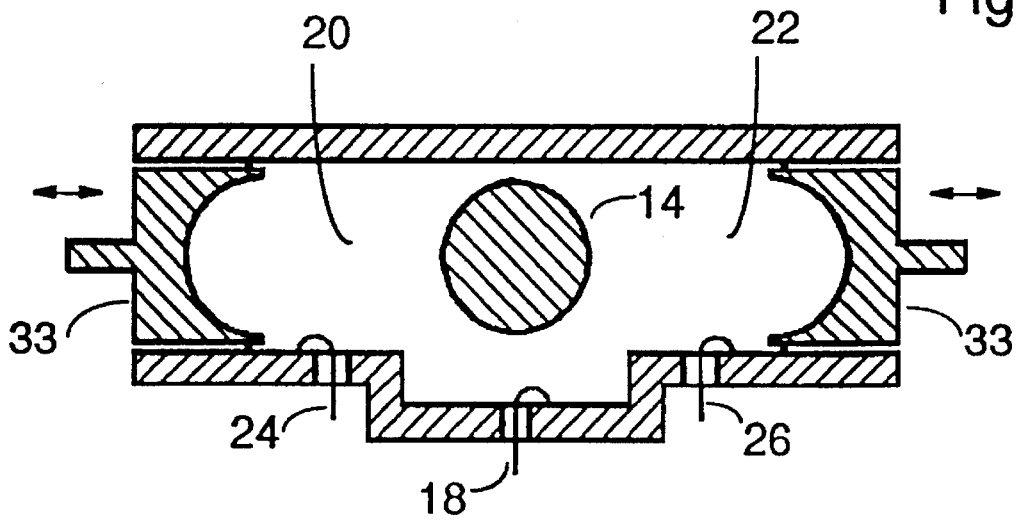
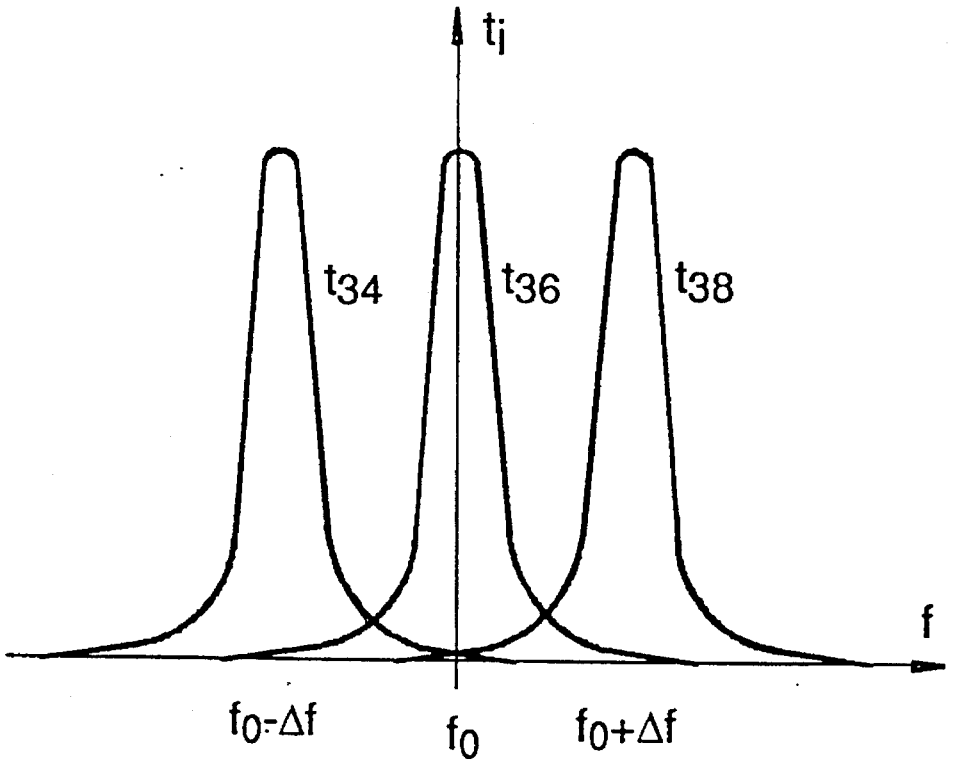
Fig.7

MICROWAVE SELECTIVE DEVICES USING LOCALIZED MODES IN WEAKLY ASYMMETRIC RESONANT CAVITIES

FIELD OF THE INVENTION

This invention relates to the structure and uses of microwave cavities and more particularly to a multimodal microwave cavity in which the distribution of energies is different for several differently localized resonant modes.

BACKGROUND OF THE INVENTION

One characteristic of many systems, including microwave systems, for the simultaneous transmission of information is the narrowness of the allowed frequency band for each transmission channel. When the channel frequencies are closely spaced, for example, in order to provide optimum usage of the available bandwidth, the mixing and separation of signals become difficult and expensive.

Microwave filters for splitting closely spaced frequencies generally have complicated designs and tuning procedures. These systems include the use of multiple filters and of complicated filter designs having little or no tuning capabilities.

Uwe Rosenberg, in a paper entitled "Multiplexing and Double Band Filtering with Common-Multimode Cavities" (IEEE Trans. MTT Vol. 38, No 12, p 1862,1990) describes a system for separating two frequencies using two nearly degenerate modes of a first cylindrical cavity. The input to this cavity is via a separate resonant cavity and the energy is coupled into the first cavity a (common) port at one end thereof. The respective output ports are each placed at a circumferencial position of the first cavity at which only one of the respective modes has a large magnetic field thereby providing selective coupling only to that mode. In this filter the energy associated with the respective modes is stored throughout the cavity, and this overlap can lead to cross-coupling between the modes and a reduction in the frequency separation and isolation between the output ports. Structures of the type described in this paper have splitting structures which imply a reduced quality factor and little scope for tuning of the system. It is quite difficult to tune structures of this type without reducing the performance of the filter.

In a paper entitled "Experimental Observations of Scarred Eigenfuctions of Chaotic Microwave Cavities", (Physical Review Letters, Vol. 67, p 785, 1991), S. Sridhar used the electromagnetic properties of a rectangular cavity with a central disk to model quantum mechanical equations. He found that when the disk is slightly uncentered, at least some of the modes split in frequency. The split modes are symmetric, in that most of the energy of one of the modes is on one side of the disk and most of the energy of the other mode is on the other side of the disk.

SUMMARY OF THE INVENTION

The present invention seeks to provide improved apparatus for the mixing and separation of signals at closely spaced but different frequencies.

It is a further characteristic of at least some of the embodiments of the invention that the design and construction are simple, compact and inexpensive, that the insertion loss is low and that tuning is especially simple.

In general, apparatus, according to a preferred embodiment of the invention, comprises an enclosure bounded by an electrically conducting boundary. Such an enclosure is commonly referred to as a resonant cavity. In particular a cavity according to the invention is characterized in that it has at least two resonant modes with generally closely spaced but different resonant frequencies, each of the modes having a major portion of its electromagnetic field energy in a different portion of the cavity. At least two mode ports are coupled to the electromagnetic fields of the individual modes and a common port is coupled to the electromagnetic fields of at least two of the modes. When two modes with closely spaced frequencies modes are present, the common port is coupled to the fields of the two modes and the mode ports are each coupled to substantially only one of the electromagnetic fields of the modes.

In one aspect of the invention, tuning apparatus is provided within the cavity which is operative to adjust the difference between the resonant frequencies of the two modes.

In a second aspect of the invention, the cavity comprises a central portion and at least two branch portions having substantially the same dimensions. A coupling mechanism within the central portion couples the at least two branch portions lightly such that the cavity has split into at least two nearby resonant frequencies. Most preferably, the coupling mechanism introduces an asymmetry into the system such that the nearby resonant frequencies are associated with modes each of which has most of its electromagnetic field energy in one of the branches. In particular most of the energy stored in the electromagnetic field of a particular mode is in a branch containing little or no energy of the other modes. In this aspect of the invention, the common port is coupled with the substantially non-zero fields in the central portion of the cavity and each of the mode ports is coupled to the electromagnetic field of one mode existing into a different one of the branches.

BRIEF DESCRIPTION OF THE DRAWINGS

The present invention will be better understood from the following description of the preferred embodiments taken together with the drawings in which:

FIGS. 3A and 3B are plots of the calculated electric field distribution, for the embodiment of FIG. 1 with a centered cylindrical rod, for two even and odd resonant modes respectively;

FIGS. 4A and 4B are plots of the calculated electric field distribution, for the embodiment of FIG. 1 with an off centered cylindrical rod, for two resonant modes with closely spaced frequencies;

FIG. 5 is a schematic drawing of a tunable microwave cavity in accordance with a second preferred embodiment of the invention;

FIG. 7 is a plot of the transmission characteristics of the embodiment of FIG. 6.

DESCRIPTION OF PREFERRED EMBODIMENTS OF THE INVENTION

Figure 1:
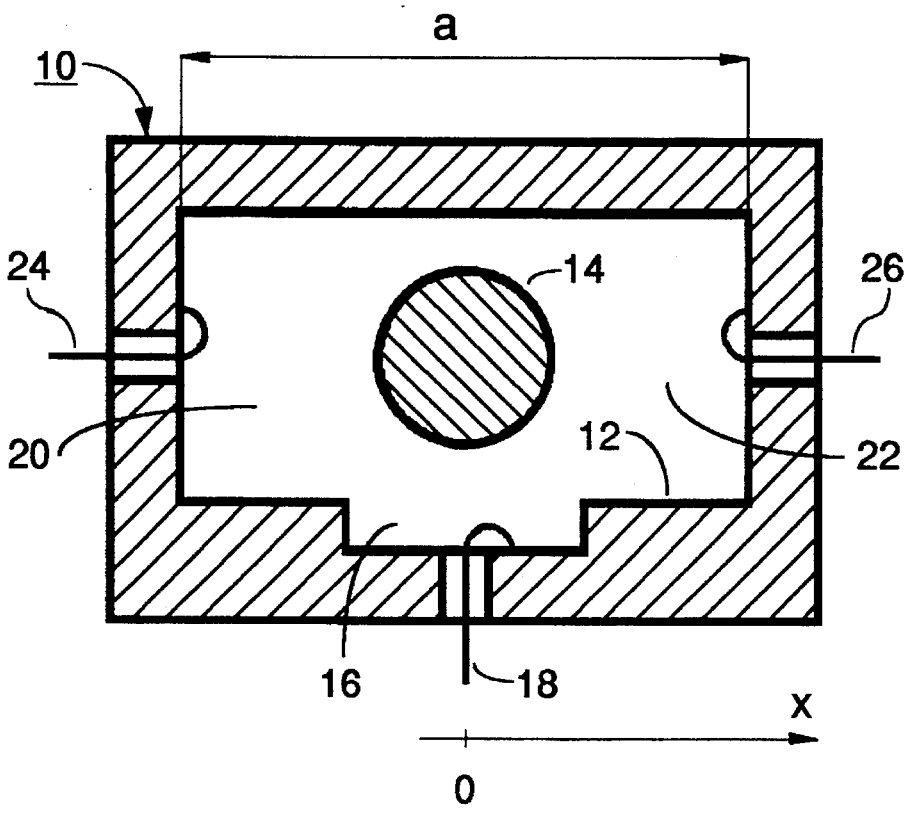
FIG. 1 is a schematic drawing of a microwave cavity in accordance with a preferred embodiment of the present invention.

Referring to FIG. 1 which is a cross-section of a closed microwave cavity in accordance with a preferred embodiment of the present invention. A rectangular cavity 10 is enclosed by conducting walls 12. The cavity has height "h" in the direction perpendicular to the drawing. A rod 14, preferably of metal, is positioned near the center of the cavity and preferably extends along the entire height of the cavity.

The walls are formed with an entrance section 16 near the rod, which contains a common port 18 for coupling electromagnetic energy into or out of the cavity.

Rod 14 is operative to divide the cavity into first and second branches 20 and 22, in which are situated respective first and second mode ports 24 and 26.

Figure 2:
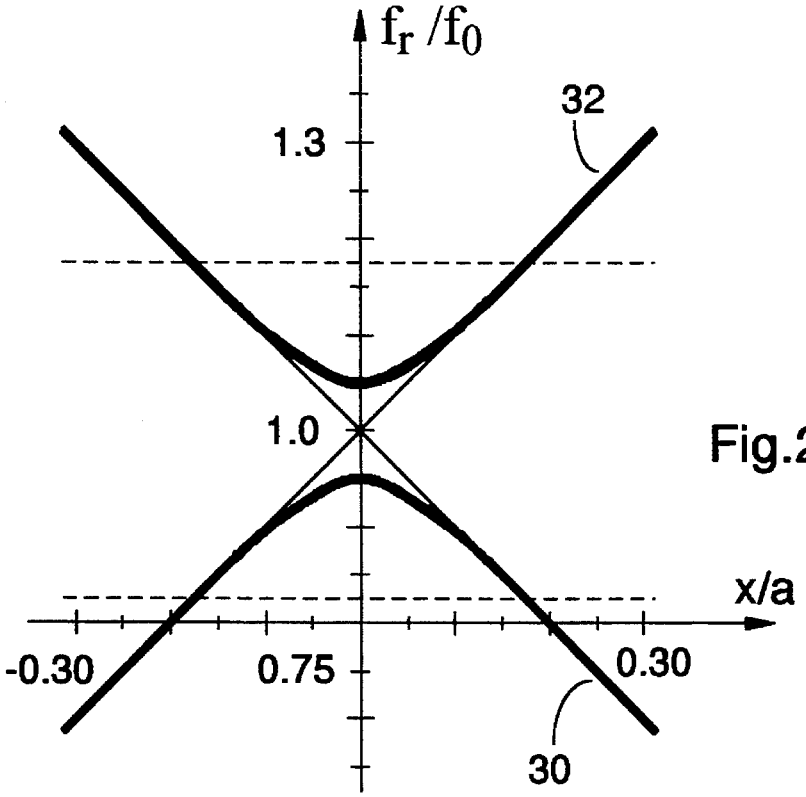
FIG. 2 is a tuning curve for the two modes of the cavity of FIG. 1 as a function of the centering of the rod.

FIG. 2 shows the variation of the resonant frequencies of a pair of related resonant modes of cavity 10 as a function of the amount of offset of rod 14 from the center of the cavity towards one of the branches. In this graph "x" is the amount of offset, "a" is the dimension of the long side of the cavity. The plotted results were calculated when the diameter of the rod is $0.32\cdot\alpha$ and the short side of the cavity is $b=0.5\cdot\alpha$. The height of the cavity was taken as $h=0.45\cdot\alpha$ to avoid additional competing resonances. As can be seen from the two related resonant frequency curves 30 and 32, the resonant frequencies are closely spaced even when the rod is centered, with the amount of frequency spacing being a function of the amount of coupling between the two branches provided by rod 14 and the quality factor Q of the cavity. However, such frequency spacing does not lead to a physical separation of the stored energies of the two modes, nor to a cavity suitable for the present invention.

Plots of the electric field of the two lowest order modes for the cavity of FIG. 1, when the rod is centered, are shown in FIGS. 3A and 3B. It is evident that these modes have substantially equal energies in the two branches of the cavity.

FIGS. 4A and 4B show the electric fields of the modes where the rod is offset by $0.025\cdot\alpha$. As can be seen these two modes are qualitatively different from the modes of FIGS. 3A and 3B in that the energy for the modes is found mainly in different ones of the branches of the cavity. As can be seen in FIGS. 4A and 4B, a small amount of energy of a mode localized in one branch is found in the other branch, this amount depends on the offset of the rod, the Q of the cavity and the amount of coupling of the branches provided by the rod. The magnetic fields for these two modes are also spatially separated in the same manner and extent as the electric fields.

In an exemplary case the long dimension "a" of the cavity is 5.066 cm, dimension b is $0.5\cdot\alpha$ and the quality factor of the cavity is of order of $10^4$ (which can be achieved by using copper or silver cavity walls with roughness less than 2 micrometers). The center frequency is then about 10 GHz. In order to avoid degradation of the Q, coupling loops 25 and 27 are preferably kept small (less than $10^{-3}\cdot\alpha^2$), placed in the middle of the short walls and oriented in the vertical plane for maximum coupling (they are shown in the horizontal plane in the FIGS. for visibility). The calculated tuning sensitivity, defined as the ratio between the difference between the frequencies of the two modes and the rod offset is 7.2 MHz/cm.

It is important to have a reasonable selectivity between the frequencies. In order to achieve a reasonable selectivity of 15 dB, a 12 MHz frequency difference is required, corresponding to a rod offset of about 1.5 mm. The amount of frequency splitting and selectivity can be increased by increasing the rod offset or by increasing the rod size, and for practical systems, a split of about 20% is possible, with selectivity of about 40 dB.

Returning now to FIG. 1, entrance section 16 is designed to be a matching section for matching the impedance of the common port 18 to the low fields of the two modes in the central portion of the cavity. This allows for substantially equal coupling of signals from the common port into the field of the two resonant modes. On the other hand, mode ports 24 and 26 are situated in regions in which only one of the modes has a substantial field strength. Thus, each of mode ports 24 and 26 is coupled to the electromagnetic field of only one of the resonant modes of the cavity.

In operation, when used as a frequency separator, a composite signal comprising two signals, each one having the frequency band centered on one of the two resonant frequencies of the cavity, is fed into the common port. One of the signals excites one of the modes, while the other excites the other of the modes. The mode ports are each coupled to the field of only one of the modes, such that one signal from one frequency band is coupled out of one of the mode ports and the signal from the other frequency band is coupled out of the second of the ports, thereby providing separation of the two signals.

In a summing functioning for FIG. 1, signals at the respective frequency bands are fed each into the mode port associated with the mode which is resonant at the respective frequency. Signals from both frequency bands are coupled out of the common port thereby providing the required summing of the signals.

It should be understood that the particular port configurations, cavity shape, rod shape and material and cavity modes are presented for the sake of easy illustration; however, it should be understood that apparatus according to the invention can also comprise, for example, rods of other shapes for introducing asymmetry of the modes, cylindrical branches and other variations of the structure.

In a preferred embodiment of the invention, the position of rod 14 can be adjusted externally. In this case the amount of asymmetry can be varied and together with it, the amount of frequency spacing. In a further preferred embodiment of the invention, the length of the cavity can be varied, as shown in FIG. 5, as for example, by a sliding short mechanism 33. In this way a frequency-separator, filter, having a variable separation between the frequency bands and a variable center frequency is easily provided.

The frequency separation and the quality factors of the modes can also be tuned by introducing additional asymmetries into the cavity, for example, dielectric or magnetic probes, or metal rods or screws in one of the branches can be used for selectively tuning the frequency and the bandpass of the mode having high energy in that branch. Such tuners may be used in conjunction with each other and may be present in more than one branch.

Microwave circuits according to the present invention are much easier to tune and align than prior art systems, substantial mode suppression is not required and the Q of the cavity, and hence the frequency selectivity is high and turnable.

Figure 6:
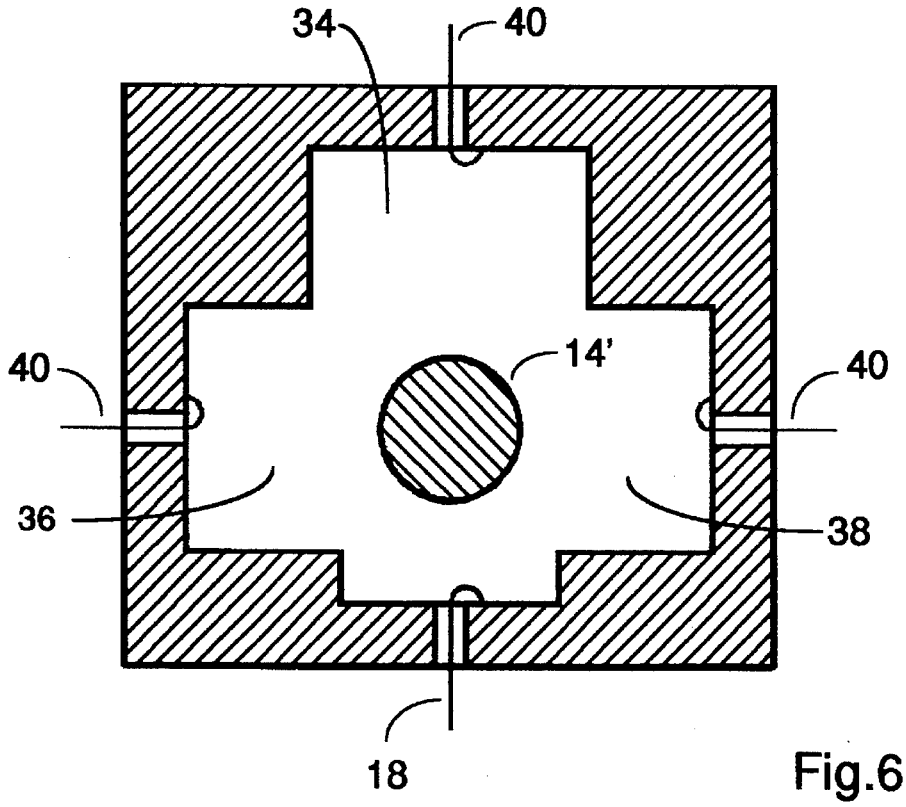
FIG. 6 is a schematic drawing of a microwave cavity in accordance with a third preferred embodiment of the invention.

FIG. 6 shows a preferred embodiment of the invention having three branches, 34, 36 and 38. Each branch is provided with a mode port 40. In operation, a rod 14' is offset toward one of the branches 36 or 38 such that three modes with closely spaced frequencies are produced, each of which has most of its field energy in one of the branches. The frequency of the mode localized in branch 34 is substantially unchanged by the movement of the rod, while the other two are spaced as described above.

FIG. 7 shows a graph of the calculated transmission curves for the system for a signal consisting of three equally spaced frequency band which enters the system at the common port 18, to each of the mode ports. As can be seen, this device acts as a separator for three closely spaced frequency bands.

Figure 8:
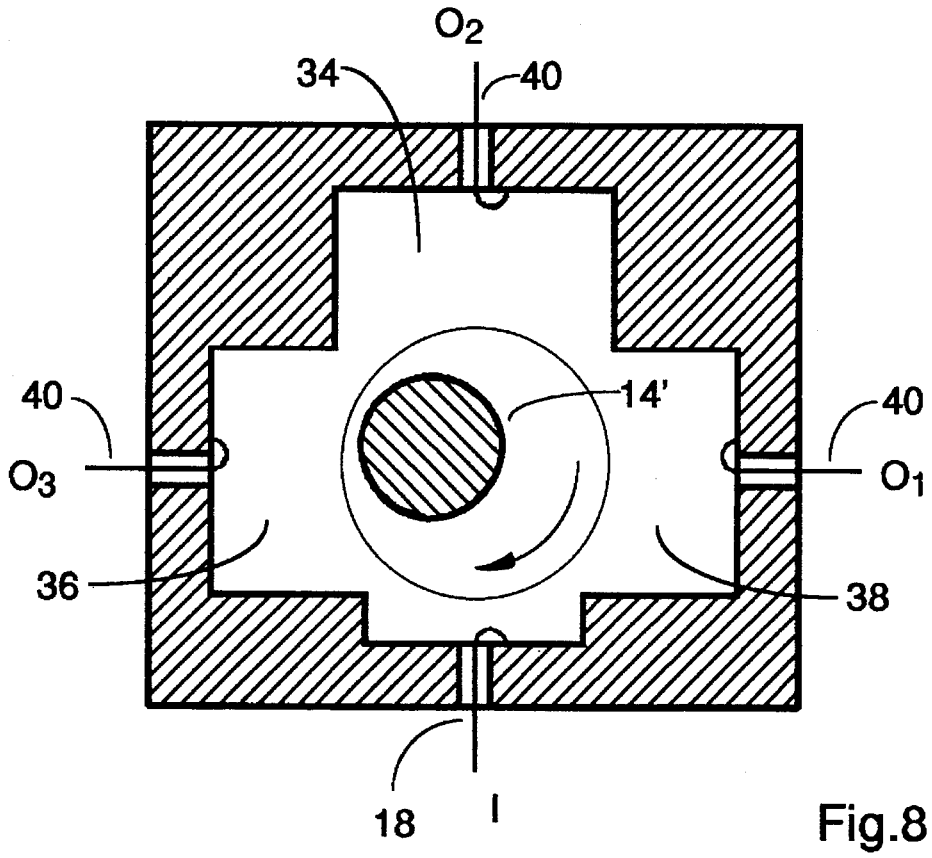
FIG. 8 is a schematic drawing of a switchable microwave cavity in accordance with a preferred embodiment of the invention.

A device as in FIG. 6 is also operative to provide a summed signal at the common port when signals are fed into the mode ports, as described above. The concept of the invention can be used in producing a wide variety of components with improved specifications. For example, FIG. 8 schematically illustrates a switch in which the offset rod is selectively offset in the direction of one of the cavities. In this case, the different frequency bands will be selectively switched to different ports depending on the positions of the rod.

Due to the small size and simple design of the device and the ease of tuning, the device is useful for many applications such as, for example, radars, satellite and terrestrial communications, spectrum analysis, etc.

While the invention has been described with respect to certain preferred embodiments, it will be appreciated that many variations, modifications and other applications of the invention may be made within the scope of the invention.

CONCLUSIONS

This section outlines the main ideas and applications related to the new class of frequency separator devices presented.

The central component of all introduced devices is the microwave cavity resonating in several modes wherein the major portion of the electromagnetic field energy of each mode is localized in a different region of the cavity. These regions are seen as nonoverlaping distinct geometric parts of the cavity for example like the branches of a T shape or of a Cross shape. For applications, there are usually desired cavities wherein the said modes have relatively close frequencies. For simplicity we call such cavities, cavities with localized modes.

For obtaining cavities with localized modes we propose the preferred weakly asymmetric resonant cavity (WARC). This is a cavity with slight asymmetries obtainable for example by variations in shape, dimensions, by tuning elements or by variations of material.

The existence of localized modes in certain cavities was observed before, but the uses of such cavities to obtain apparatuses, as presented here, are new. The shapes of the presented cavities are new too. Also new are certain elements which are important for applications such as: the special input portion and output portion which are coupled to the electromagnetic fields of several modes, essential for the efficiency of the devices, see FIGS. 1, 5, 6, 8, and the fields in these portions in FIGS. 4A and 4B; the uses of the special tuning elements for adjusting the difference between resonant frequencies in cavities with localized modes, necessary for practical purposes; and the simple coupling structures between the branches of the cavity, which are also signal separating structures, and which lead to high Q.

The introduced devices can comprise one or several inputs, one or several outputs and tuning elements. Based on these elements one can distinguish several classes of devices:

1) devices with one input and several outputs, such as frequency separator and filters;
2) devices with several inputs and one output, such as multiplexors and summators;
3) devices with several inputs and several outputs;
4) devices with dynamic tuning or moving elements, such as switches;
5) devices classified by the type of tuning elements.

Additionally, devices comprising several cavities with localized modes can be considered.

Examples of devices with one input and several outputs are the ones functioning as a frequency separator, like the filters obtainable from the cavities from FIGS. 1, 5, 6. In these examples an input portion was used, to feed the device with a multiple frequency band input signal, and the input was coupled to the electromagnetic field of several modes, while each output was coupled to the electromagnetic field of a single mode and provide a single band signal.

The dual functioning of the frequency separator is the summator or multiplexor, performed by devices similar with the separator, but where the input of the separator becomes output, coupled to the electromagnetic field of several modes of the summator, while the outputs of the separator become inputs coupled each to the electromagnetic field of a single mode of the summator. For this reason, as usually done, for each separator is automatically considered the summator which consists in the separator with the dual functioning or else said, obtained by changing the inputs into outputs and outputs into inputs. For example, such devices are the multiplexors, such as the ones obtainable by cavities like in FIGS. 1, 5, 6, with one output and several inputs.

The cavities may contain moving components, for example for periodic, dynamic or adaptive tuning such as presented by switches. An example is the device in FIG. 8 where the tuning rod can move together with a rotating or switching structure 15. Other usual moving structures can be considered as well. The rods inside the cavities provide means of simple tuning being at the same time efficient coupling structures and controlling the reasonant frequency spacing. Due to the use of a single cavity, the presented devices have a simple design, simple tuning and compact shape. Due to the minimization of the coupling structures, the presented devices present small signal loss and good versatility.

Devices with several inputs and several outputs wherein each input or output can be coupled to the electromagnetic field of one or several modes can be directly defined. Examples of such devices can be obtained by coupling cavities like in FIGS. 1, 5, 6, 8. Their use can be easily imagined when considering combinations with classical devices. For exemplification, the cavity presented in FIG. 6 can be used as a cavity with several inputs and several outputs. For example in a two input two output cavity presented in FIG. 6, the ports in the branches 36 and 38 are output ports while the port 18 and the port in branch 34 are input ports. Consider that the sizes, length and width of the four branches of FIG. 6 can differ. Another multiple input multiple output structure can be obtained by connecting two or more cavities. For example two cavities as presented in FIG. 6 can be connected by merging the branch 36 from the first cavity with the branch 38 from the second cavity. In a preferred embodiment, two cavities like in FIG. 6 are connected by one cavity like in FIG. 1 in the following way: branch 38 from the first cavity like in FIG. 6 is merging with the branch 20 of FIG. 1 and the branch 22 of FIG. 1 is merging with branch 36 from the second cavity like in FIG. 6. Multiple input multiple output cavities can be used as filters, multiplexors or switches like in the examples described before. They may contain tuning elements or switching elements as described for the filters or switches.

It is a direct observation that structures comprising several WARCs or WARCs coupled with other type of cavities like the classical ones usually form a WARC too. WARCs can be coupled by and with WARCs and or with classical devices. Classical devices can be coupled at inputs or outputs of WARCs. For example, as above, WARCs like the ones presented in FIGS. 1 and 6 can be coupled by merging two branches of different cavities into a common branch. Another way of coupling several cavities is by classical connections between the ports. For different practical purposes the skilled in the art will easily consider different such couplings. Generally for each classic cavity device the skilled in the art may consider replacing certain structures by WARC structures.

It can be observed that due to the use of a single cavity, the presented devices have a simple design, simple tuning, compact shape and are robust. The coupling and separating structures are integrated in the same cavity. Due to the minimization of the coupling structures, the presented devices present small signal loss and good versatility.

We claim:

1. A frequency separator for separating two or more frequency bands, said frequency separator comprising:

a resonant cavity, said resonant cavity including one input and two or more outputs for coupling electromagnetic energy between said two or more frequency bands, wherein said resonant cavity comprises two or more branches and includes a rod symmetrically placed with respect to said two or more branches;

said rod defining separator means for determining two or more localized modes, said resonant cavity resonating in said two or more localized modes, wherein electromagnetic field of each of said localized modes being of substantial amplitude in a different branch and said electromagnetic field being of small amplitude in the other branches;

an input portion wherein electromagnetic fields of said two or more localized modes are coupled to said input, said electromagnetic fields of said two or more localized modes being of small and of comparable amplitude in said input portion, each of said outputs being placed in a branch where the electromagnetic field of only one of said two or more localized modes is of substantial amplitude, whereby said frequency bands being determined by the resonant frequencies of said localized modes.

2. A frequency separator according to claim 1, wherein said resonant cavity includes at least one tuner operative to adjust the difference between said resonant frequencies of at least two of said localized modes.

3. A frequency separator according to claim 1 wherein said resonant cavity includes a coupling structure situated at a juncture of said branches, said coupling structure being operative in providing limited coupling between said branches and being operative in controlling the frequency spacing of at least two of said localized modes.

4. A frequency separator according to claim 3 wherein said coupling structure is mobile.

5. A frequency separator according to claim 3 including means for selectively changing the configuration of said coupling structure whereby a signal having a given frequency at said input is switched from one to another of said outputs.

6. A frequency separator according to claim 3 including at least one tuning element in at least one branch of said branches.

7. A frequency separator according to claim 6 wherein said tuning element is a sliding short mechanism.

8. A frequency separator according to claim 1 comprising:

at least two subapparatuses, each one of said subapparatuses being an apparatus according to claim 1; and means for coupling said subapparatuses.

* * * * *